US009620349B2

(12) United States Patent
Roeck et al.

(10) Patent No.: US 9,620,349 B2
(45) Date of Patent: Apr. 11, 2017

(54) ICR CELL OPERATING WITH A DUPLEXER

(71) Applicant: Bruker BioSpin AG, Faellanden (CH)

(72) Inventors: Walter Roeck, Zurich (CH); Christoph Martin Gosteli, Wallisellen (CH); Arthur Schwilch, Uster (CH)

(73) Assignee: Bruker BioSpin AG, Faellanden (CH)

( * ) Notice: Subject to any disclaimer, the term of this patent is extended or adjusted under 35 U.S.C. 154(b) by 0 days.

(21) Appl. No.: 14/961,908

(22) Filed: Dec. 8, 2015

(65) Prior Publication Data

US 2016/0181083 A1 Jun. 23, 2016

(30) Foreign Application Priority Data

Dec. 18, 2014 (DE) ..... 10 2014 226 498

(51) Int. Cl.
*H01J 49/00* (2006.01)
*H01J 49/38* (2006.01)
*H01J 49/02* (2006.01)

(52) U.S. Cl.
CPC ..... *H01J 49/38* (2013.01); *H01J 49/0027* (2013.01); *H01J 49/022* (2013.01)

(58) Field of Classification Search
USPC ..... 250/282
See application file for complete search history.

(56) References Cited

U.S. PATENT DOCUMENTS 4,945,234 A * 7/1990 Goodman ..... H01J 49/38 250/281
6,111,718 A * 8/2000 Jones ..... G11B 19/00 360/62
7,126,337 B2 * 10/2006 Oppelt ..... G01R 33/3657 324/318

OTHER PUBLICATIONS

T. Chen et al., "Optimized circuit for excitation . . . ", Review of Scientific Instruments 85, 066107 (2014).
Peter B. Grosshans et al., "Linear excitation and detection . . . ", International Journal of Mass Spectrometry and Ion Prcesses 139 Nov. 24, 1994.
C.L. Hendrickson "Simplified Application of Quadrupolar . . . ", Soc. Mass Spectrom. 1995, 6, 448-452.
"Relais-Wikipedi", Dec. 8, 2014. URL: https://de.wikipedia.org/w/index.
"Panasonic PhotoMOS", Nov. 22, 2012, URL:http://www.distrelec.de/Web/Downloads/.
Mathur, R. et al., "A Low-Noise, Wideband . . . ", Journal of the American Society for Mass Spectrometry, Dec. 2007, vol. 18, Issue 12, pp. 2233-2241.

(Continued)

*Primary Examiner* — Phillip A Johnston
(74) *Attorney, Agent, or Firm* — Paul Vincent

(57) ABSTRACT

An ICR cell (01) operates with a duplexer (08), which is an integral part of a transmission and receiving device (09) of an FT-ICR mass spectrometry device. The device transmits a transmitter (03) voltage to at least one electrode (11) of the ICR cell during an ion excitation phase and protects a preamplifier (04) from overvoltage. An ion received signal passes through a reception path (12) to the preamplifier during an ion detection phase. The duplexer has at least one active serial switch (07) with two switchable states, each with different series impedances, which is inserted in the reception path (12). As a result, a duplexer for an ICR cell of an FT-ICR mass spectrometry device is provided in which at least one electrode can be used for both ion excitation and for subsequent ion detection.

14 Claims, 6 Drawing Sheets

(56) References Cited

OTHER PUBLICATIONS

Chen, T. et al., "Excitation and Detection" Proc. 60th ASMS Conf. on Mass Spectrometry & Allied Topics, Vancouver, Canada, Mai 20-24, 2012.
Chen, T. et al., "Improving Radial and Axial . . . ", 61st Amer. Soc. Mass Spectrometry Conf., Minneapolis,MN, Jun. 9-13, 2013.
Dunnivant, F.M. et al., "Fourier Transform Ion Cyclotron . . . ", http://people.whitman.edu/-dunnivfm/C_MS_Ebook/CH5/5_5_6. html, Jun. 24, 2014.
Wikipedia, "Relaytypes", http://en.wikipedia.org/wiki/Relay, Jul. 7, 2014.
Wikipedia, Microelectromechanical . . . http://en.wikipedia.org/wiki/Microelectromechanical_systems, Jul. 17, 2014.
Wikipedia, "Micro-Opto-Electro-Mechanical . . . ", http://en.wikipedia.org/wiki/Micro-Opto-Electro-Mechanical_Systems, Jul. 17, 2014.
Schweikiiard, L. et al., "Quadrature Detection for the . . . ", AIP Conf. Proc. 606, 647-651, 2002.
Marshall, A.et al., "Fourier transform ion . . . ", International Journal of Mass Spectrometry 215, 59-75, 2002.

* cited by examiner

Prior Art

Prior Art

Prior Art

Prior Art

ICR CELL OPERATING WITH A DUPLEXER

This application claims Paris convention priority from DE 10 2014 226 498.7 filed Dec. 18, 2014 the entire disclosure of which is hereby incorporated by reference.

BACKGROUND OF THE INVENTION

The invention relates to an ICR cell operating with a duplexer comprising one or more semiconductor components for use in a device for Fourier transform ion cyclotron resonance (FT-ICR) mass spectrometry comprising a preferably superconducting magnet for generating a magnetic field in the direction of a z axis, wherein the duplexer is an integral part of a transmission and receiving device of an FT-ICR mass spectrometry device, which, on the one hand transmits the voltage of the transmitter during an ion excitation phase over the transmitter path of the duplexer to at least one electrode of the ICR cell and protects a preamplifier from overvoltage by antiparallel diodes and a serial impedance for current limiting and, on the other hand, transmits an ion received signal, namely the voltage of the same electrode following from the influenced charge, via a receive path to the preamplifier during an ion detection phase.

Such an arrangement is known from Chen, T.; Kaiser, N. K.; Beu, S. C.; Hendrickson, C. L. and Marshall, A. G., *Excitation and Detection with the Same Electrodes for Improved FT-ICR MS Performance*, Proc. 60th ASMS Conf. on Mass Spectrometry & Allied Topics, Vancouver, Canada, May 20-24, 2012 (=reference [2])

or from

Chen, T.; Kaiser, N. K.; Beu, S. C, Blakney G. T., Quinn J. P., McIntosh, D. G., Hendrickson, C. L. and Marshall, A. G., *Improving Radial and Axial Uniformity of the Excitation Electric Field in a Closed Dynamically Harmonized FT-ICR Cell,* 61st Amer. Soc. Mass Spectrometry Conf., Minneapolis, Minn., Jun. 9-13, 2013 (=reference [2]).

Fourier transform ion cyclotron resonance (FT-ICR) is a technical method for high resolution mass spectrometry.

Customary cells used for FT-ICR mass spectrometry are divided into cubic and cylindrical geometries: one pair of opposing electrodes for ion excitation, and another pair, offset by 90 degrees, for detection, as shown by way of example in FIG. 2 (or FIG. 3*a*). A refinement attempts to improve this existing arrangement by using all electrodes for ion detection, more particularly by using the electrode pair previously used only for excitation also for detection.

By adding the signals of all four electrodes having a respective alternating phase (0 degrees, 180 degrees), a higher frequency resolution is achieved (actually, a higher frequency is achieved; in FT-ICR mass spectrometry, this corresponds to a higher mass resolution). This detection type is known by the term harmonic detection method (FIG. 3*b*) (see reference [9]).

However, such an arrangement can also be used to achieve greater sensitivity (higher signal-to-noise ratio) by way of in-phase addition of the signals since an ion received signal is detectable during the entire orbit (cyclotron). The respective signals of two adjoining electrodes are added, the signals of the two other electrodes are subtracted (FIG. 3*c*) (see reference [8]).

A basic diagram of this known arrangement of the electrode pairs is shown in FIG. 4*a*. A spatially opposing electrode pair (20 and 21) of an ICR cell (01), together with the associated preamplifiers (04*b* and 04*d*), is used only for detection, while the second electrode pair (40 and 41) is connected either to the preamplifiers (04*a* and 04*c*) or the transmitters (03*a* and 03*b*, shown as two individual transmitters here; however, in practice, often a single transmitter comprising a 0/180 degree splitter is used) via the duplexers (08*a* and 08*b*) for the ion excitation. This arrangement results in four freely combinable receive paths and two transmission paths for various applications.

A single path, comprising a shared electrode (11) for excitation and detection, is shown in FIGS. 4*b* and 4*c* for the excitation and detection case. A single duplexer from FIG. 4*a* (08*a* or 08*b*) is substantially composed of two circuit paths S1 and S2 (FIGS. 4*b* and 4*c*, 42 and 43). S1 (42) is closed, respectively in a conducting state, and S2 (43) is opened, respectively in a non-conducting state, during the ion excitation phase, and the states are reversed during the ion detection phase.

In the closed state, S1 transmits the ion excitation voltage to the shared electrode, and in the non-conducting state it ensures that the detected ion received signal is not attenuated. In the non-conducting state, S2 protects the downstream preamplifier from the high ion excitation voltage, and in the conducting state it transmits the ion received signal.

The objective of such an arrangement is to achieve a signal-to-noise ratio as high as possible, and/or a frequency resolution as high as possible, without impairing or limiting any other system properties to the extent possible. The most important aspects that must be met by the application are listed below:

1. So as to achieve a higher frequency resolution (harmonic detection method, FIG. 3*b*), at least one electrode pair must be designed for transmitting and receiving, and the ion received signals must be appropriately combined.
2. So as to maximize the signal-to-noise ratio during the ion detection phase, the conducting behavior of S2 (43, preamplifier protection during the ion excitation phase, FIGS. 4*b* and 4*c*) must be as ideal as possible.
   In addition, a potentially present capacitance from the receive path (12) to circuit ground (13) must be minimized, and a potentially present parallel resistance to circuit ground must be maximized.
3. So as to ensure protection of the preamplifier during the ion excitation phase, S2 must have a sufficiently high isolation and input/output isolating voltage.
4. So as to maximize the signal-to-noise ratio during the ion detection phase, the isolation of S1 (42, transmission of the ion excitation voltage to the shared electrode (11), FIGS. 4*b* and 4*c*) must be as ideal as possible.
5. In the conducting state, the resistance of S1 (FIGS. 4*b* and 4*c*), together with the ICR cell capacitance (FIG. 5, detail 51), forms a low-pass filter and accordingly must be low resistive so as not to influence the frequency response of the ion excitation voltage.
6. The duplexer, together with the circuit paths S1 and S2 thereof, must be able to change sufficiently quickly between the two basic states so that the functionality of a changeover switch between excitation and detection is ensured.

The most important aspects that must be met for a specific implementation are listed below:

1. The main problem of the implementation lies in the highly resistive source impedance of the ICR cell, which necessitates a preamplifier having a minimal equivalent noise current source. The duplexer must not burden this highly resistive system in an interfering manner (FIG. 5).

2. If the preamplifier protection is implemented by way of a switched path S2 (FIGS. 4*b* and 4*c*), the actuation of the switch must be ensured under all circumstances so as to protect the preamplifier from the ion excitation voltage.
3. So as to be able to utilize the improved properties of an ICR cell comprising a shared electrode pair for ion excitation and detection, it is advantageous for the behavior of the downstream preamplifier to be as low-noise as possible and matched to the source impedance of the cell. The term "noise matching" is often used in the literature for this behavior.

The electronic circuit published in the reference [1] describes in great detail the current state of preamplifier technology for FT-ICR mass spectrometry as it is often used today, however without a duplexer. This paper clearly reveals which parameters are essential for a preamplifier design. It is derived in detail that the total input capacitance (51), composed of the electrode capacitance, the feed capacitance to the preamplifier, the input capacitance of the preamplifier, and further parasitic capacitances, must be minimized to achieve a maximal signal-to-noise ratio, while the total parallel resistance (52), which in turn is composed of the input resistance of the preamplifier, the resistance to ground for electrode DC potential (10) and further parallel losses, must be maximized.

The best signal-to-noise ratio possible using current technologies (apart from a conceivable cryogenic preamplifier, which could be used to reduce the noise even further) can undoubtedly be achieved from a single electrode pair by way of such an arrangement. However, this system can only be used for ion detection since the other electrode pair is needed for ion excitation, which accordingly precludes certain applications, such as the harmonic detection method and/or further increases in sensitivity by way of in-phase combination of the received signals (see reference [8]).

FIG. 2 shows this existing prior art according to reference [4]. This general composition of a conventional ICR cell, as it is used in the majority of commercially available FT-ICR mass spectrometry devices, includes two electrodes (22 and 23) for ion excitation and two electrodes (20 and 21) for ion detection. The ion excitation voltage is provided by two transmitters (03*a* and 03*b*, which are shown as two individual transmitters here; however, in practice often a single transmitter comprising a 0/180 degree splitter is used), and the detected ion received signal is typically amplified by two preamplifiers (04*a* and 04*b*, shown as two preamplifiers here, but usually implemented as a single preamplifier having a differential input) in a manner that is as low-noise as possible.

In an ICR cell comprising a shared electrode pair for ion excitation and detection, the preamplifier protection is added to the minimization of the total input capacitance and the maximization of the total parallel resistance. Few articles have been published that address this topic. Hereafter, the features of the circuit published in references [2] and [3] (FIG. 6) are described. A distinction is made between the implementation for circuit paths S1 and S2 (FIGS. 4*b* and 4*c*, 42 and 43).

a) S1: All known implementations of the described principles in FIGS. 4*b* and 4*c* have in common that an anti-parallel diode pair (FIG. 6, detail 05) is used for S1 (42).

The ion excitation voltage is several times greater than the diode forward voltage, and any half wave is able to pass the diode almost loss-free. In contrast, the detected ion received signal is several times smaller than the diode forward voltage, and the diodes act as a blocking switch for the signal.

b) S2: So as to protect the preamplifier from the ion excitation voltage, a voltage divider is used, composed of a reactance connected in series with the preamplifier input (this is a series capacitor in the published variant, see FIG. 6, detail 60) and multiple anti-parallel diode pairs (FIG. 6, detail 06 from reference [2]) in parallel with the amplifier input. The diode pairs limit the maximum alternating voltage present at the preamplifier input during the phase of ion excitation. The current in the arrangement is determined by the dimensioning of the series capacitor (numerical example based on the following assumptions: 200 m/z mass-to-charge ratio, 21 Tesla magnet, frequency of the ion excitation voltage approximately 1.6 MHz having a peak voltage of 200 V. At a series capacitance of 1 nF, a peak current of almost 2 A flows in the series capacitor, or approximately 1 A per diode). Limiting the current by way of a capacitor has the advantage that the reactance of a capacitor does not have noise, in comparison with an equally large real resistor. Depending on the selection of this capacitor, this arrangement has the following properties:

a. The maximum achievable signal-to-noise ratio during the ion detection phase is heavily influenced by a further voltage divider, composed of the series capacitance (60), the parasitic capacitances of the diode pairs (numerical example: 4× $C_{D@0V}$ of approximately 1.5 pF results in 6 pF) and the parasitic input capacitance (numerical example: $C_i$ approximately 10 pF) of the preamplifier (combined as Cp in 61).

A small value of the series capacitance means a high reactance and thus reduces the necessary ampacity of the diodes in parallel with the amplifier input (ion excitation phase), but at times divides the detected ion signal down drastically, thereby worsening the signal-to-noise ratio achievable by the arrangement (ion detection phase).

b. At a high value of the series capacitance (60), the resulting voltage divider practically has no influence on the maximum achievable signal-to-noise ratio. In return, a much higher current flows through the diode pairs (06) during the ion excitation phase. To ensure a reliable operation, diodes must be selected which are designed for higher current, or the higher current must be divided to even more diode pairs. Diodes having a higher ampacity have a larger chip surface, and hence a larger parasitic capacitance (low-frequency diodes small-signal model in FIG. 7, detail 73). At the same time, the parasitic diode parallel resistance (70) also decreases. Both result in the maximum achievable signal-to-noise ratio being reduced.

A distribution of the higher current to a larger number of diode pairs (see reference [2]) has the same effect since the entire chip surface of all diodes increases.

A further feature of the circuit published in references [2] and [3] is the resistance to ground for electrode DC potential (FIG. 6, detail 10) of the electrode (11), shared for excitation and detection. The resistance to ground discharges potential electrical charges from the electrode and generates the DC reference potential for the ICR cell and advantageously is selected as highly resistive as possible for the signal-to-noise ratio.

It is the object of the present invention to provide a duplexer for an ICR cell of an FT-ICR mass spectrometry device in which at least one electrode can be used for both ion excitation and then for ion detection, wherein the duplexer used for this purpose ensures the protection of the preamplifier from the excitation voltage and does not significantly impair the signal-to-noise ratio.

SUMMARY OF THE INVENTION

This object is achieved in a simple and effective manner in that at least one active serial switch having two switchable states, each with different series impedances and controlled by a control electronics unit, is inserted in the receive path and as part of the duplexer transmits in the ion detection phase the received signal by its low series impedance as lossless as possible to the preamplifier and protects the preamplifier in the excitation phase by its high series impedance and the antiparallel diodes.

The duplexer that is used may be equipped with one or more semiconductor components and is intended for use in a device for FT-ICR mass spectrometry. This device preferably comprises a superconducting magnet for generating a magnetic field in the direction of a z axis.

The duplexer is to be regarded as an integral component of a transmitter-receiver of a FT-ICR mass spectrometry device, which, on the one hand, transmits the voltage of the transmitter during an ion excitation phase over the transmitter path of the duplexer to at least one electrode of the ICR cell and protects the preamplifier from overvoltage by antiparallel diodes and a serial impedance for current limiting and, on the other hand, transmits the ion received signal, namely the voltage of the same electrode following from the influenced charge, via the receive path of the duplexer to the preamplifier during the ion detection phase. According to the invention, the duplexer is characterized in that at least one active serial switch having two switchable states, each with different series impedances, is inserted in the receive path.

The above-described solution according to the invention opens up new options for implementing systems having improved performance for FT-ICR mass spectrometry devices.

a) This solution according to the invention is specifically advantageous for ICR cells having four electrodes, and more, so as to further improve the signal-to-noise ratio using two electrode pairs by appropriate addition of the ion signals of all electrodes. In addition, quadrature detection is also possible in ICR cells having two electrode pairs, which allows the spectra of positive and negative ions to be separated (see reference [8]).

b) Furthermore, this solution according to the invention offers advantages in the harmonic detection method for increasing the frequency resolution; depending on the manner of the combination of the ion signals, either the signal-to-noise ratio or the frequency resolution can be increased (see references [8] and [9]).

c) This solution according to the invention, together with the preamplifier, can be used outside and also within the vacuum, in the immediate vicinity of an ICR cell electrode. The use within the vacuum is of particular interest since in this way the parasitic capacitance of the vacuum signal feedthrough (approximately 6 pF), by omitting the same, can be further optimized, and thus the signal-to-noise ratio increased.

d) This solution according to the invention can be used at room temperature and also at cryogenic conditions below 100 K.

It goes without saying that other variations not described are possible, which a person skilled in the art will be able to implement.

Further advantages of the invention will be apparent from the description and the accompanying drawings. Likewise, according to the invention, the above-mentioned features and those described hereafter can be used either alone or as several together in any arbitrary combinations with each other. The shown and described embodiments shall not be construed as an exhaustive enumeration, but rather are of an exemplary nature for the description of the invention.

The drawing shows the invention, which will be described in more detail hereafter based on exemplary embodiments. In the drawings:

DESCRIPTION OF THE PREFERRED EMBODIMENT

Figure 1:
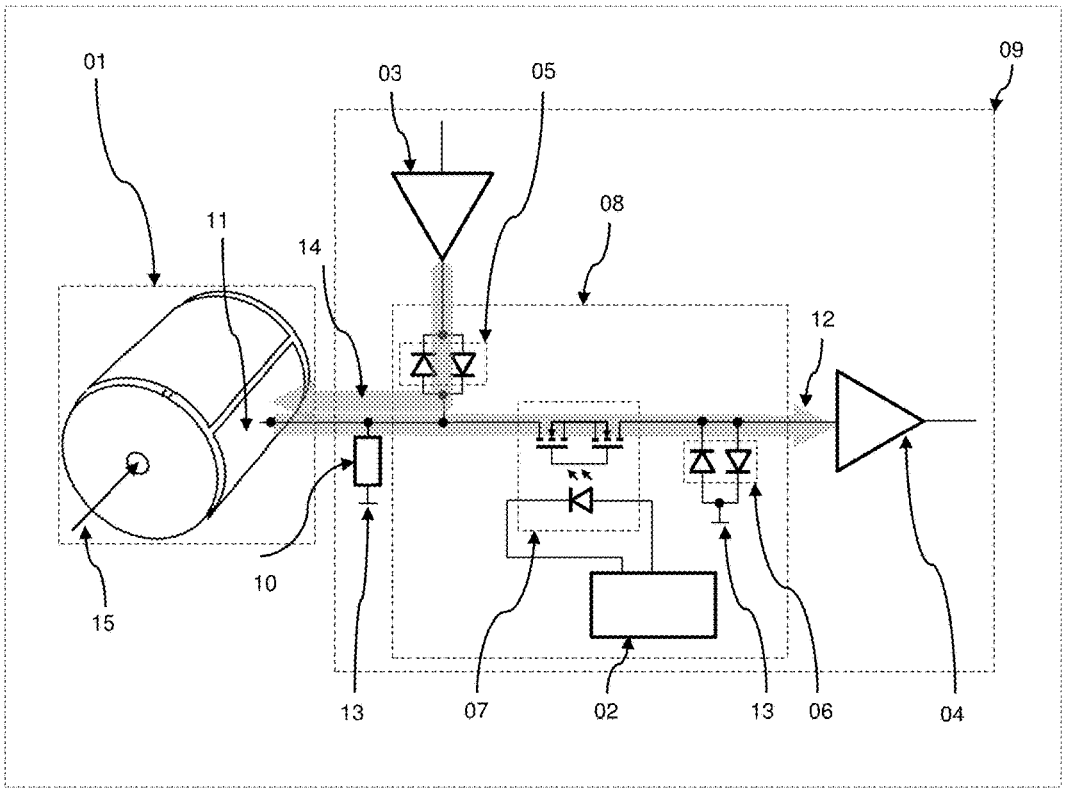
FIG. 1 shows one embodiment of the device according to the invention.
Figure 2:
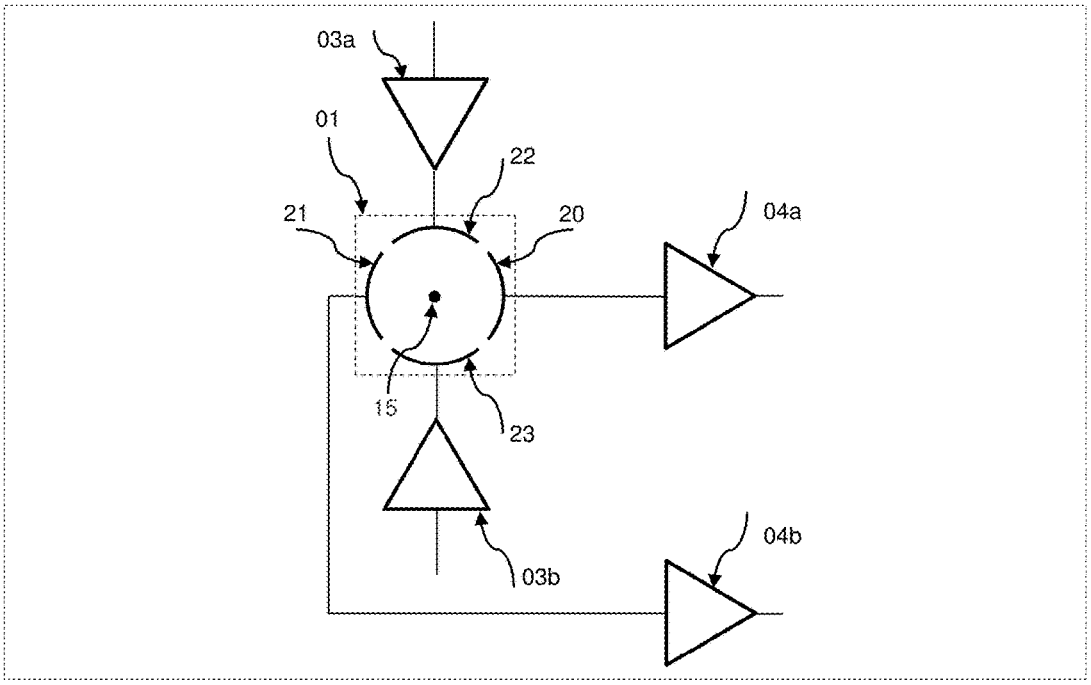
FIG. 2 shows a basic schematic overview of an FT-ICR mass spectrometry device having separate electrodes for excitation and detection according to the prior art.
Figure 3A:
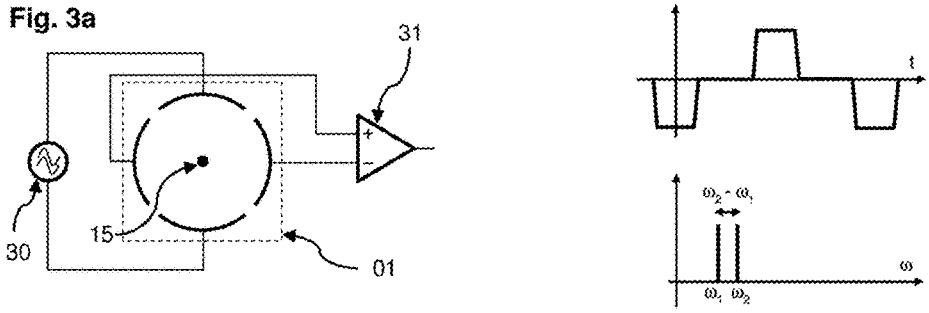
FIGS. 3*a* through 3*c* show a comparative basic representation of the conventional detection method using the harmonic detection method according to the prior art.
Figure 3B:
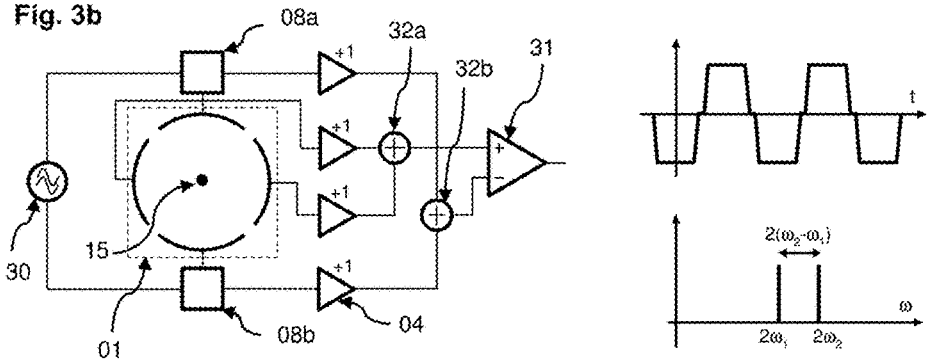
Figure 3C:
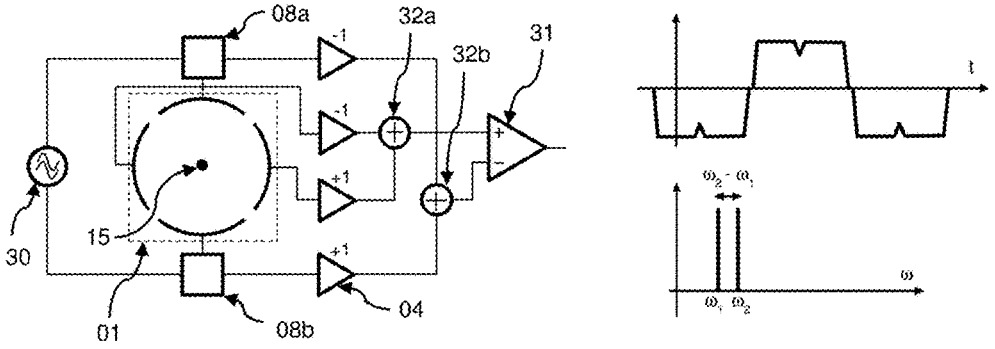
Figures 4A, 4B, 4C:
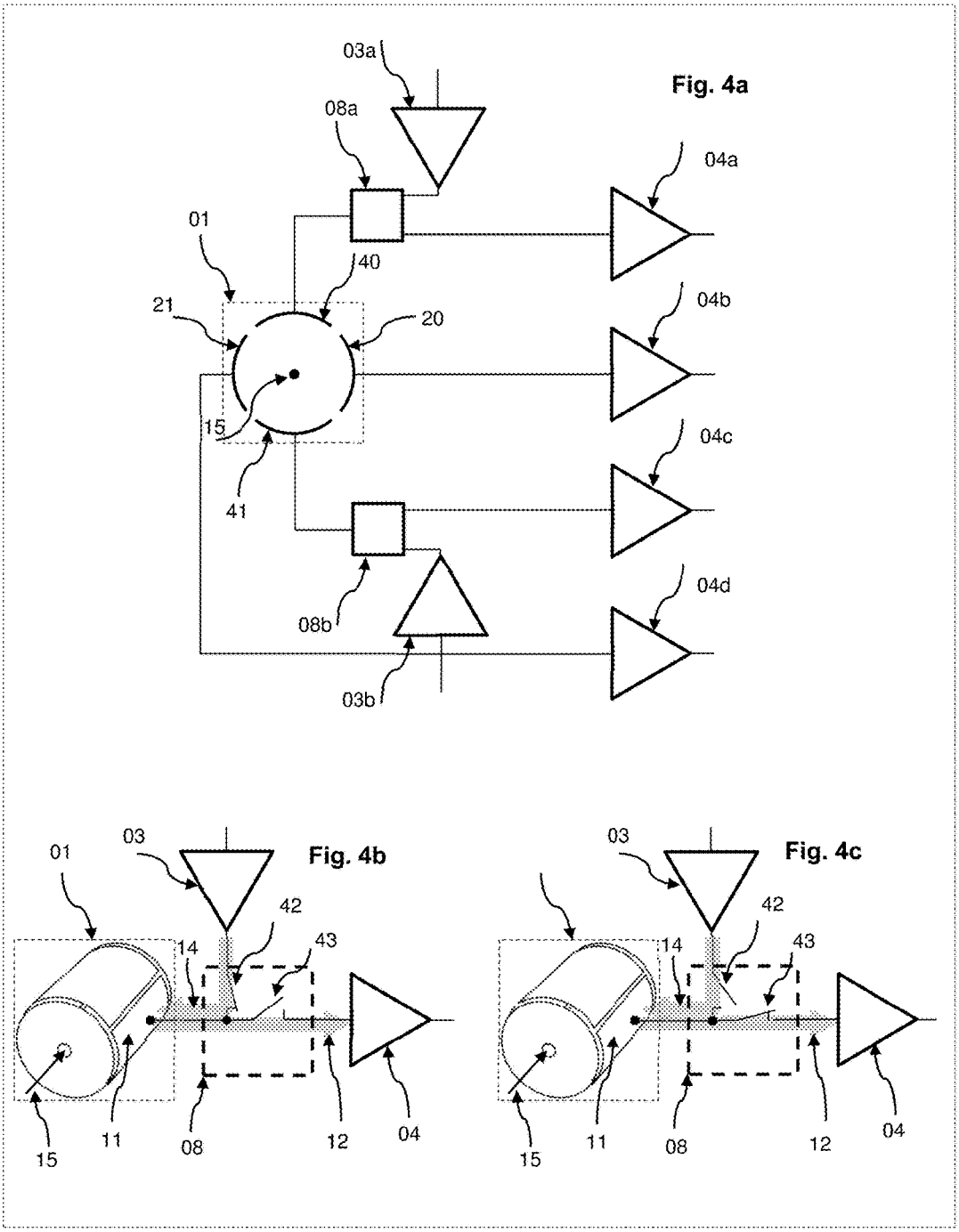
FIGS. 4*a* through 4*c* show a basic schematic overview of an FT-ICR mass spectrometry device having shared electrodes for excitation and detection according to the prior art.
Figure 5:
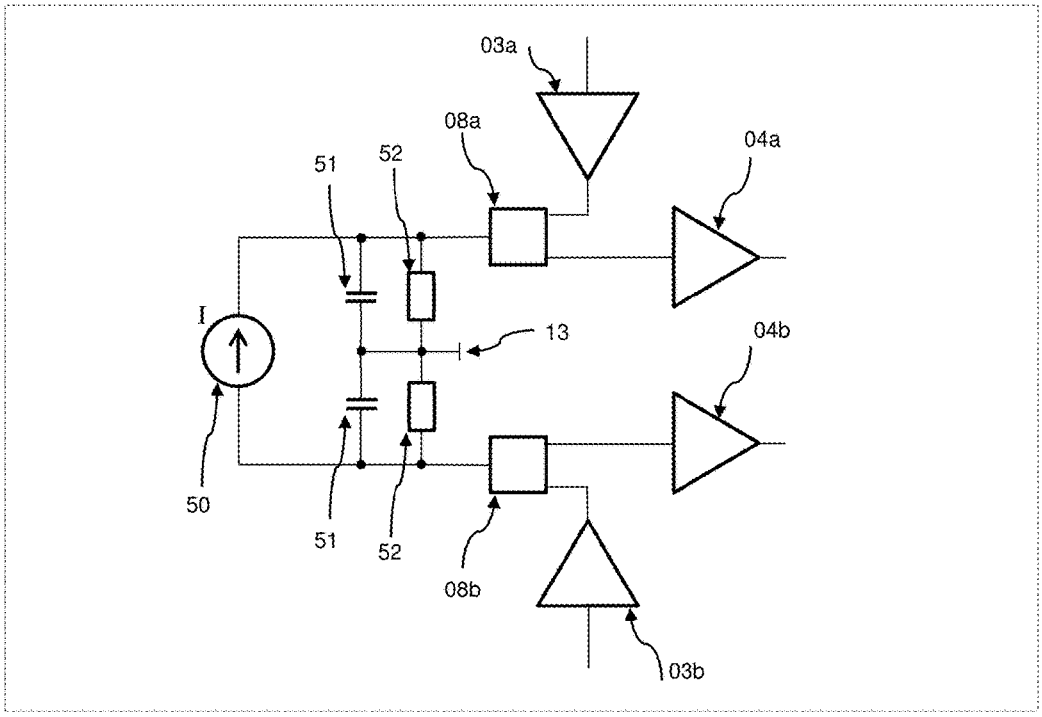
FIG. 5 Prior Art
FIG. 5 shows a simplified electrical equivalent circuit of an electrode pair of an ICR cell according to the prior art.
Figure 6:
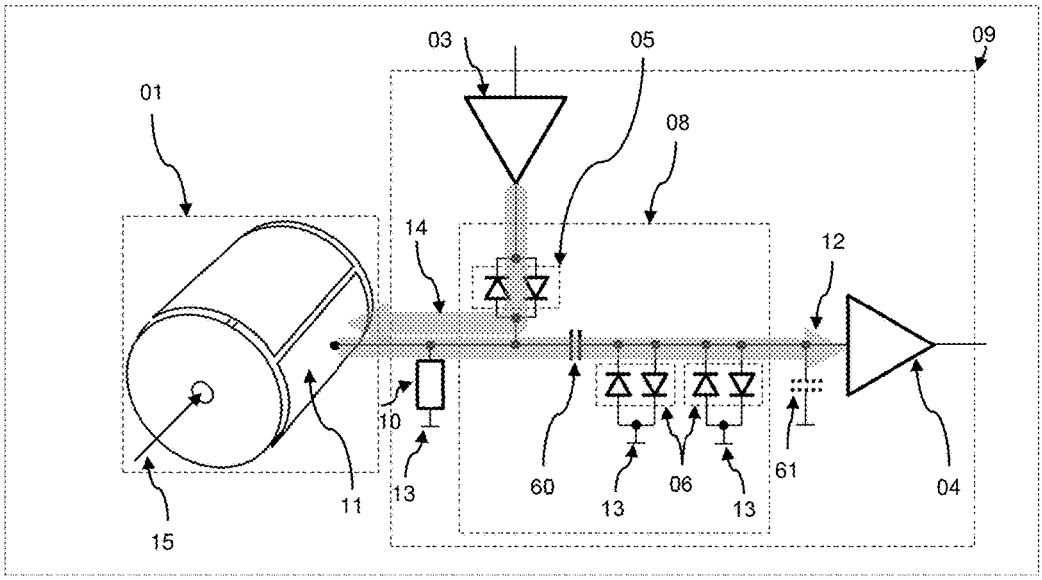
FIG. 6 shows a schematic overview of an FT-ICR mass spectrometry device having shared electrodes for excitation and detection, as it was published in [2] and [3], according to the prior art.

FIG. 1 illustrates one embodiment of the duplexer 08 according to the invention with the ICR cell 01 for an FT-ICR mass spectrometry device, wherein the duplexer shall be considered an integral part of a transmission and receiving device 09. This embodiment of the duplexer is furthermore characterized by the use of a PhotoMOS relay 07 as active serial switch in series with the preamplifier, which, together with the anti-parallel diode pair 06, protects the preamplifier from the ion excitation voltage and the activation of which is carried out by way of a control electronics unit 02.

In preferred embodiments of the invention, the series impedance of the active serial switch has a low resistive real part of less than 30 ohm during the ion detection phase, and a high-ohmic impedance of more than 1 kiloohm during the ion excitation phase.

Further embodiments are characterized in that the active serial switch has a capacitance of less than 1.5 pF from the receive path to circuit ground and to the control electronics unit and/or an impedance of more than 1 gigaohm from the receive path to circuit ground and to the control electronics unit during the ion detection phase.

Embodiments in which an optically controlled switch is inserted in the receive path as the active serial switch are also advantageous.

As an alternative or in addition, the active serial switch may have a high-ohmic impedance without actuation in further embodiments of the invention.

Particularly preferred are embodiments of the ICR cell according to the invention in which, for the protection of the preamplifier, an active serial switch, in combination with downstream one or more diode pairs and/or diode pairs having less than 0.2 pF per diode and/or diode pairs comprising parallel resistances in the range of more than 4 gigaohm per diode are inserted in the receive path.

Embodiments in which, for the purpose of transmitting the ion excitation voltage to the ICR cell, diode pairs are inserted having less than 0.2 pF per diode and/or parallel resistances in the range of more than 4 gigaohm per diode are also advantageous.

The duplexer is preferably composed of an, in particular optical, active serial switch with low capacitance and high resistance ($C_{iso}$ typically 0.8 pF and $R_{iso}$ greater than 1 gigaohm), against circuit ground, for example implemented by way of a PhotoMOS relay (design variant of a solid-state relay, see reference [5]). An implementation as MEMS (see reference [6]) or MOEMS (see reference [7]), comprising a downstream anti-parallel diode pair at the preamplifier input and an anti-parallel diode pair for transmitting the ion excitation voltage is also conceivable.

During the ion excitation phase, the active serial switch blocks and, in a first approximation, may be considered an electrical impedance, composed of an electrical resistor (approximately 100 megaohm) and a capacitor (approximately 35 pF) connected in parallel to the resistor. Since the preamplifier input impedance is also of a highly resistive nature, the anti-parallel diode pair at the input is necessary to limit the voltage resulting at the preamplifier input to the diode forward voltage. Due to the blocking or highly resistive active serial switch, however, the current through the diodes is severely limited.

A numerical example based on the following assumptions: 200 m/z mass-to-charge ratio, 21 Tesla magnet, frequency of the ion excitation voltage approximately 1.6 MHz having a peak voltage of 200 V. A peak current of approximately 70 mA flows through an individual diode.

During the ion detection phase, the active serial switch is conducting, and the signal arrives at the preamplifier input unhindered. In the conducting state, the series resistor should be small (less than 30 ohm), so that the thermal noise thereof does not influence the overall performance in an interfering manner and is thus quite a bit below the noise of the preamplifier.

The active serial switch is normally open during the ion excitation phase and must be actively actuated for the ion detection. In this particular embodiment, the active serial switch is characterized in that the activation thereof is carried out by way of an optical transmission of the control signal. In this way, the influence of the parasitic capacitance ($C_{iso}$ typically 0.8 pF) and of the parasitic resistance ($R_{iso}$ greater than 1 gigaohm) adversely affecting the signal-to-noise ratio from the receive path to the control electronics unit or circuit ground, which usually exists for any semiconductor switch having more than two ports, is minimized.

Figure 7:
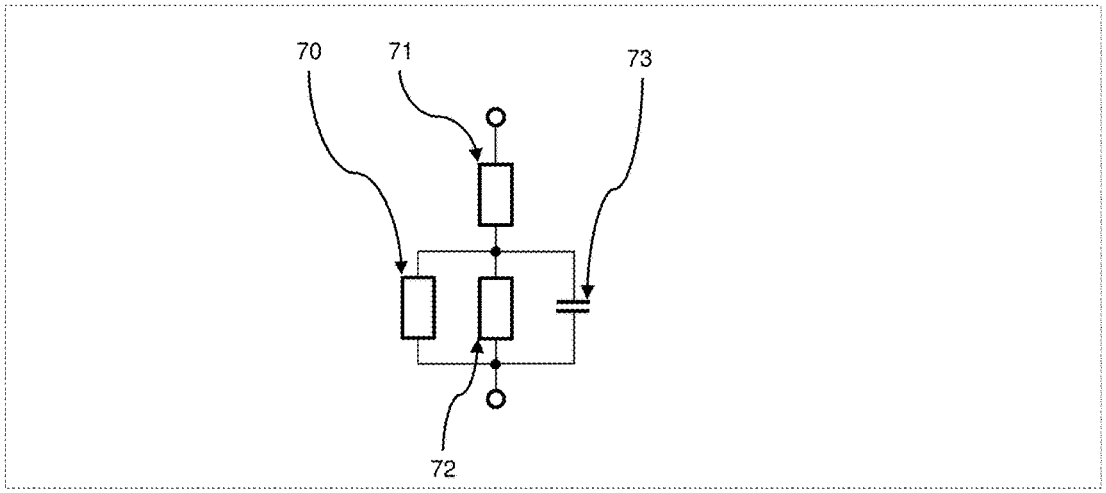
FIG. 7 shows a low-frequency small-signal model of a single diode according to the prior art.

It is only the advantage of an active serial switch having two different resistance states for ion excitation and ion detection that also allows the use of diode pairs having a very small (less than 0.2 pF per diode) parasitic parallel capacitance (FIG. 7, 73, individual diode) and a parasitic parallel resistance (70, individual diode) in the range of more than 4 gigaohm per diode. GaAs PIN diodes are typically suited for this.

| List of reference numerals: | |
|---|---|
| ICR cell | 01 |
| control electronics unit | 02 |
| amplifier for the ion excitation voltage | 03 |
| preamplifier for the detected ion received signal | 04 |
| anti-parallel diode pair for transmitting the ion excitation voltage | 05 |
| anti-parallel diode pair for voltage limitation | 06 |
| active serial switch | 07 |
| duplexer | 08 |
| transmission and receiving device | 09 |
| resistance to ground for electrode DC potential | 10 |
| individual electrode of an ICR cell | 11 |
| receive path | 12 |
| circuit ground | 13 |
| transmitter path | 14 |
| z axis, in axial direction to the ICR cell | 15 |
| ion detection electrode 90 degrees | 20 |
| ion detection electrode 270 degrees | 21 |
| ion excitation electrode 0 degrees | 22 |
| ion excitation electrode 180 degrees | 23 |
| ion excitation source | 30 |
| differential amplifier | 31 |
| summing unit | 32 |
| ion excitation/detection electrode 0 degrees | 40 |
| ion excitation/detection electrode 180 degrees | 41 |
| S1: circuit path for ion excitation voltage | 42 |
| S2: circuit path for the detected ion received signal | 43 |
| current source in the ICR cell equivalent circuit | 50 |
| parallel circuit composed of the ICR cell capacitance, preamplifier input capacitance and parasitic capacitances on the reception path | 51 |
| parallel circuit composed of resistance to ground for electrode DC potential, preamplifier input resistance (e.g., by feed supply) and parasitic resistances on the reception path | 52 |
| series capacitor | 60 |
| parasitic parallel capacitance composed of the diode capacitance and the preamplifier input capacitance | 61 |
| parallel resistance of an individual diode caused by leakage currents | 70 |
| series resistance of a single diode | 71 |
| differential resistance of a single diode | 72 |
| parallel capacitance of a single diode | 73 |

LIST OF REFERENCES

[1] Mathur, R.; Knepper, R. W.; O'Connor, P. B., *A Low-Noise, Wideband Preamplifier for a Fourier-Transform Ion Cyclotron Resonance Mass Spectrometer*, Journal of the American Society for Mass Spectrometry, December 2007, Volume 18, Issue 12, pp 2233-2241.

[2] Chen, T.; Kaiser, N. K.; Beu, S. C.; Hendrickson, C. L. and Marshall, A. G., *Excitation and Detection with the Same Electrodes for Improved FT-ICR MS Performance*, Proc. 60th ASMS Conf. on Mass Spectrometry & Allied Topics, Vancouver, Canada, May 20-24, 2012.

[3] Chen, T.; Kaiser, N. K.; Beu, S. C, Blakney G. T., Quinn J. P., McIntosh, D. G., Hendrickson, C. L. and Marshall, A. G., *Improving Radial and Axial Uniformity of the Excitation Electric Field in a Closed Dynamically Harmonized FT-ICR Cell,* 61st Amer. Soc. Mass Spectrometry Conf., Minneapolis, Minn., Jun. 9-13, 2013.

[4] Dunnivant, F. M., *Fourier Transform Ion Cyclotron—Mass Spectrometry*, URL http://people.whitman.edu/~dunnivfm/C_MS_Ebook/CH5/5_5_6.html, retrieved on Jun. 24, 2014.

[5] Wikipedia, *Relaytypes*, section *Solid-state relay*, URL http://en.wikipedia.org/wiki/Relay, retrieved on Jul. 7, 2014.

[6] Wikipedia, *Microelectromechanical Systems*, URL http://en.wikipedia.org/wiki/Microelectromechanical_systems, retrieved on Jul. 17, 2014.

[7] Wikipedia, *Micro-Opto-Electro-Mechanical Systems*, URL http://en.wikipedia.org/wiki/Micro-Opto-Electro-Mechanical_Systems, retrieved on Jul. 17, 2014.

[8] Schweikhard, L.; Drader, J. J.; Shi, S. D.-H.; Hendrickson, C. L. and Marshall, A. G., *Quadrature Detection for the Separation of the Signals of Positive and Negative Ions in Fourier Transform Ion Cyclotron Resonance Mass Spectrometry*, AIP Conf. Proc. 606, 647-651, 2002

[9] Marshall, A. G.; Hendrickson, C. L., *Fourier transform ion cyclotron resonance detection: principles and experimental configurations*, International Journal of Mass Spectrometry 215, 59-75, 2002

We claim:

1. A Fourier transform ion cyclotron resonance (FT-ICR) mass spectrometry device, the device comprising:

an ICR cell having at least one electrode;

a magnet or a superconducting magnet, said magnet structured for generating a magnetic field, which keeps ions on a cyclotron orbit in a direction of a z axis in an axial direction with respect to said ICR cell; and a transmission and receiving device having a duplexer, a transmitter and a preamplifier, said duplexer comprising one or more semiconductor components structured for use in mass spectrometry, wherein said transmitter generates a transmitter voltage which is transported during an ion excitation phase via a transmitter path in said duplexer to said at least one electrode of said ICR cell, said duplexer being structured to protect said preamplifier from overvoltage using antiparallel diodes and a serial impedance for current limiting, wherein said transmission and receiving device is also structured to transmit an ion received signal in response to a voltage of said at least one electrode following from an influenced charge and via said receive path of said duplexer to said preamplifier during an ion detection phase, wherein said transmission and receiving device comprises at least one active serial switch having two switchable states, with each switching state having a different series impedance, wherein said active serial switch is controlled by a control electronics unit inserted in said receive path as part of said duplexer to transmit, in said ion detection phase, the received signal via a low series impedance as lossless as possible to said preamplifier and to protect said preamplifier in the excitation phase via a high series impedance and said antiparallel diodes.

2. The device of claim 1, wherein said active serial switch is structured to generate a series impedance having a low resistive real part of less than 30 ohm during the ion detection phase and a high impedance of more than 1 kiloohm during the ion excitation phase.

3. The device of claim 1, wherein, during the ion detection phase, said active serial switch has a capacitance of less than 1.5 pF from said receive path to circuit ground and to said control electronics unit and/or an impedance of more than 1 gigaohm from said receive path to circuit ground and to said control electronics unit.

4. The device of claim 1, wherein said active serial switch is an optically controlled switch.

5. The device of claim 1, wherein, by appropriate arrangement and structuring of said active serial switch within said duplexer, said active serial switch has a high impedance without actuation.

6. The device of claim 1, wherein said active serial switch is circuited upstream of said antiparallel diodes, said antiparallel diodes having less than 0.2 pF per diode and/or having parallel resistance in a range of more than 4 gigaohm per diode, thereby limiting an input voltage of said preamplifier.

7. The device of claim 1, wherein said duplexer further comprises a diode pair inserted in said transmitter path, said diode pair having less than 0.2 pF per diode and/or parallel resistances in a range of more than 4 gigaohm per diode in order to switch and transmit an ion excitation voltage over said transmitter path to said ICR cell.

8. The device of claim 6, wherein GaAs PIN diodes are inserted as said antiparallel diodes directly at an input of said preamplifier for preamplifier protection.

9. The device of claim 7, wherein GaAs PIN diodes are inserted as said diode pair for transmitting said ion excitation voltage to ICR cell electrodes.

10. The device of claim 1, wherein two or more electrodes of said ICR cell are each configured with a respective duplexer, wherein each duplexer comprises said active serial switch.

11. The device of claim 1, wherein said duplexer is located in an immediate vicinity of an electrode within a vacuum of said ICR cell.

12. The device of claim 1, wherein a MEMS (=microelectromechanical systems) switch or a MEOMS (=microoptoelectromechanical systems) switch is inserted in said receive path as said active serial switch.

13. A method for operating the device of claim 2, wherein, by appropriate arrangement of said duplexer and preamplifier semiconductor devices, said duplexer and said preamplifier are operated at room temperature or at cryogenic temperatures below 100 K.

14. A method for operating the device of claim 2, wherein said duplexer is structured and circuited to increase a signal-to-noise ratio by appropriately combining all ion received signals amplified by preamplifiers and/or to increase a frequency resolution using a harmonic detection method by combining all ion received signals amplified by preamplifiers and/or to detect positive and negative ions using a quadrature detection method.

* * * * *